United States Patent [19]

Terry

[11] 4,356,575

[45] Nov. 2, 1982

[54] KNEELING APPLIANCE FOR USE WITH BATHTUBS

[76] Inventor: Linda T. Terry, 321 Ehringhaus St., Hendersonville, N.C. 28739

[21] Appl. No.: 210,579

[22] Filed: Nov. 26, 1980

[51] Int. Cl.[3] ..... A47K 3/00

[52] U.S. Cl. ..... 4/559; 4/574; 4/576; 297/187; 297/426

[58] Field of Search ..... 4/559, 571, 574, 578, 4/579, 576; 297/187, 426

[56] References Cited

U.S. PATENT DOCUMENTS

| | | | |
|---|---|---|---|
| 35,304 | 11/1901 | Pendergast | 4/574 |
| 1,877,602 | 9/1932 | Silverman | 297/187 |
| 1,890,815 | 12/1932 | Kazowski | 297/187 |
| 2,069,124 | 1/1937 | Wojtalewicz et al. | 297/187 |
| 2,101,259 | 12/1937 | Landau | 297/187 |
| 3,391,409 | 7/1968 | Gatley | 4/599 X |

*Primary Examiner*—Henry K. Artis
*Attorney, Agent, or Firm*—Harvey B. Jacobson

[57] ABSTRACT

A cushioned or padded kneeling appliance particularly adapted for use in association with a bathtub when it is desired to reach into the interior area of the bathtub to perform some utilitarian function, such as bathing an infant, cleaning the tub, or the like. The device includes a rigid frame having a generally horizontally disposed lower cushion or pad oriented outwardly of and alongside the lower outer surface of a bathtub wall and an upper cushion or pad overlying the top edge portion of the bathtub wall to enabling a person using the device to kneel on the lower pad and lean on the upper pad thereby reducing discomfort which would occur if a person kneeled on the tile floor of the bathroom or the like and leaned against the top edge portion of a bathtub wall. The pads or cushions are removable for cleaning or replacement and the frame is of sectional construction to enable it to be disassembled for storage in a compact condition and capable of vertical adjustment for use with bathtub walls having different heights.

5 Claims, 3 Drawing Figures

KNEELING APPLIANCE FOR USE WITH BATHTUBS

BACKGROUND OF THE INVENTION

1. Field of the Invention

The present invention generally relates to a kneeling appliance for use with bathtubs or alongside of other containers which includes a lower pad or cushion forming a cushioned kneeling surface and an upper pad or cushion adapted to be engaged by the upper torso area of a person kneeling on the lower pad when the person reaches into the area a bathtub or other container when the applicance is placed alongside of the bathtub wall or the like.

2. Description of the Prior Art

Kneeling pads of various types have been provided for use by those engaged in various activities. In some instances, the pads are attached directly to the wearer so that they move with the person using the pads. Additionally, mats are frequently provided alongside of a bathtub which primarily are intended for a bather to step on when entering or exiting from the bathtub and, of course, it has been known to utilize such bath mats as a kneeling pad or cushion when cleaning the bathtub or the like. The following U.S. patents illustrate structures which are relevant to the present invention:

U.S. Pat. Nos:

D-35,304—Nov. 19, 1901—Pendergast
1,529,498—Mar. 10, 1925—Novak
2,140,902—Dec. 20, 1938—Fischer
2,525,531—Oct. 10, 1950—Dorff
2,719,576—Oct. 4, 1955—Emmett

SUMMARY OF THE INVENTION

An object of the present invention is to provide a kneeling appliance for use in association with the wall of a bathtub which includes a vertical outer wall and an inner wall spaced therefrom with the upper edges thereof interconnected by a generally horizontal top edge portion in which the appliance includes a pad or cushion resting on the bathroom floor alongside the outer surface of the lower end portion of the outer wall of the bathtub, a supporting framework and an upper pad or cushion overlying the top edge portion of the bathtub wall so that when a person kneels on the lower pad or cushion, and reaches into the interior of the bathtub, the person's knees will be cushioned against contact with the bathroom floor and the chest area of the person will be cushioned against contact with the top edge portion of the bathtub wall.

Another object of the present invention is to provide a kneeling appliance in accordance with the preceding object in which the frame includes upper and lower end portions which detachably support the upper and lower pads to enable removal thereof for cleaning and replacement when necessary.

Still another object of the invention is to provide a kneeling appliance in accordance with the preceding objects in which the supporting frame is constructed of separable, longitudinally adjustable vertical components forming two side members of the frame to enable the applicance to be disassembled for storage or shipment in a knocked-down compact condition and also enabling some degree of vertical adjustment to enable the device to be utilized with bathtub walls of different heights and with other similar containers.

Yet another important object of the present invention is to provide a kneeling appliance which is inexpensive to manufacture, comfortable in use, capable of many uses and capable of being constructed of various materials.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
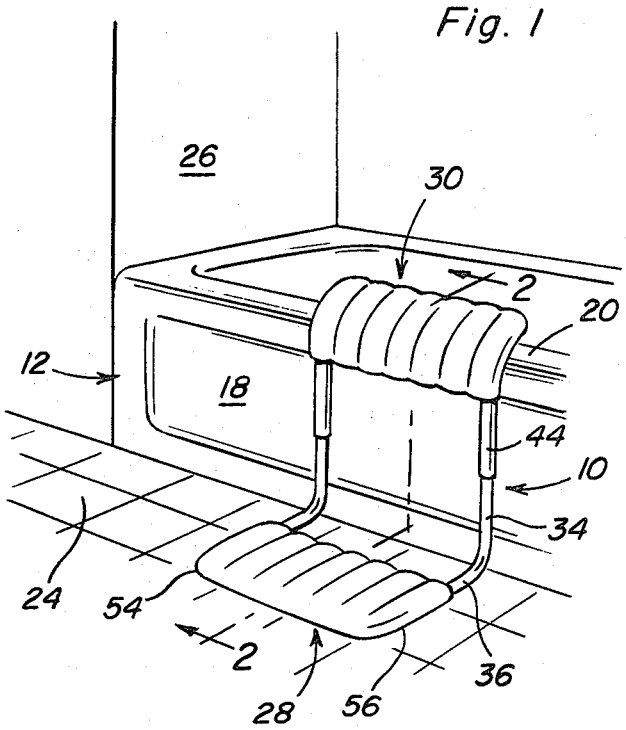
FIG. 1 is a perspective view of the kneeling appliance of the present invention illustrating it in association with a bathtub.
Figure 3:
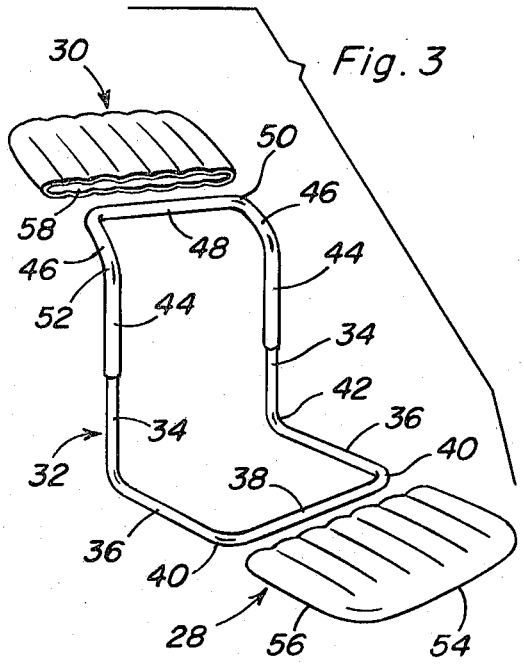
FIG. 3 is an exploded perspective view illustrating the manner in which the upper and lower pads are associated with the frame of the kneeling appliance.

The kneeling appliance of the present invention is generally designated by reference numeral 10 and is illustrated in use in association with a conventional bathtub generally designated by the numeral 12 in which the bathtub includes an outer wall assembly generally designated by the numeral 14 which consists of an inner wall 16 and an outer wall 18 spaced horizontally from each other with the two walls 16 and 18 being generally vertical and interconnected at their top edge by a top wall or upper edge portion 20 which provides a generally horizontal ledge or top wall portion having rounded corner portions 22. The construction of the bathtub 12 is conventional and, as illustrated, is installed in a bathroom with a horizontal floor 24 which may be tile or any other surface normally provided in a conventional bathroom. The tub may be installed in an alcove having an end wall 26 or the like or may be a free-standing tub or any other conventional tub in which the wall extends upwardly from the floor.

The kneeling appliance 10 includes a lower pad or cushion generally designated by the numeral 28, an upper pad or cushion generally designated by the numeral 30 and an frame generally designated by the numeral 32. The frame 32 includes a pair of vertical members 34 which are generally parallel to each other and spaced horizontally from each other. The lower end of each of the vertical members 34 extends outwardly in the form of a horizontal leg 36 with the legs 36 being horizontally disposed and spaced horizontally from each other. The outer ends of the horizontal legs 36 are interconnected by a horizontal member 38 generally perpendicular to the legs 36. The legs 36 and horizontal member 38 have the lower pad 28 mounted thereon and the legs 36 are joined to the horizontal member 38 by rounded right angle corners 40 and the legs 36 are joined to the vertical members 34 by rounded right angle corners 42. The vertical members 34, legs 36 and horizontal member 38 form one component of the frame 32. The other component of the frame 32 is formed by a pair of vertical members 44 which are telescopically and adjustably engaged with the vertical members 34.

Figure 2:
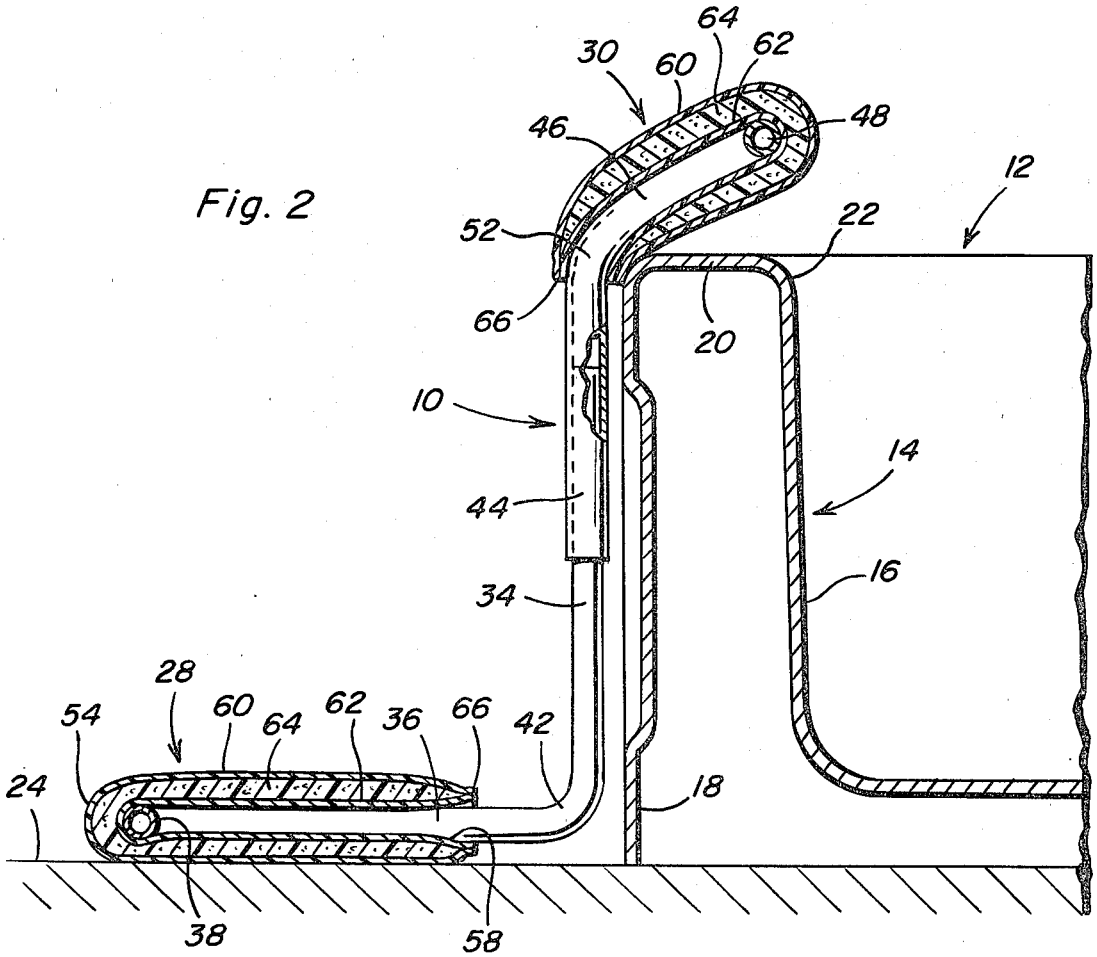
FIG. 2 is a vertical sectional view, on an enlarged scale, taken substantially upon a plane passing along section line 2—2 of FIG. 1 illustrating further structural details of the appliance and its association with the bathtub wall.

At the upper ends of the vertical members 44, a pair of parallel inclined legs 46 are provided with the outer ends thereof being interconnected by a horizontal member 48 which is parallel to the horizontal member 38 with the horizontal member 48 being connected to the inclined legs 46 by rounded right angle corners 50 and the legs 46 are connected to the vertical members 44 by rounded corners 52 which are less than 90° as illustrated in FIG. 2 with the upper pad 30 being mounted on the horizontal member 48 and legs 46. As illustrated, the components of the frame 32 are constructed of tubing which may be chrome plated or otherwise waterproof or rustproof such as providing a vinyl coating or may be constructed of anodized aluminum or other suitable material.

As illustrated, when the kneeling appliance is used, it is positioned so that the lower pad 28 and the corresponding portion of the frame is alongside the bottom outer surface of the outside wall member 18 with the appliance resting on the bathroom floor 24 so that a person may kneel on the lower pad 28 by placing both knees thereon if desired, or only one knee if desired. The upper pad or cushion 30, mounted on the members 48 and 46 is positioned in overlying relation to the top wall portion 20 of the bathtub wall 14 but is upwardly slanted in relation to the surface to provide cushioning support to the rib area or chest area of a person leaning toward the interior of the bathtub and performing some ulitarian function therein, such as bathing an infant in the bathtub, cleaning the bathtub or performing some other operation which requires that the hands and arms of the person kneeling beside the tub be extended interiorly of the tub for an extended period of time.

While the construction of the pads or cushions may vary, they preferably are in the form of an envelope having a closed outer edge 54 and closed side edges 56, but an open inner edge 58 to enable the pads to be slid onto the frame and removed therefrom to facilitate cleaning or replacement when desired. Each of the pads may include an outer member 60 and an inner member 62 spaced and cushioned by cushioning material 64 which may be any well-known cushioning material such as fibrous material, foamed material, or the like. The cushion is generally U-shaped in configuration with the open edge 58 telescopically receiving the lower or upper end portion of the frame and the cushions may be identical or the upper cushion or pad may be of slightly less extent. The inner and outer members 60 and 62 may be vinyl or other plastic film material having the edges thereof heat sealed or otherwise secured as at 66 to define the open edge 58 of the pad. Other materials may be used in forming the cushions such as fabric coverings and the like in which event the edges could be stitched together with any suitable decorative bias tape or the like. The envelope-type construction of the pads enables the pads to be slid onto and removed from the frame 32 to facilitate cleaning of the pads and replacement thereof in the event of damage to the pads during use.

The telescopic connection between the vertical members 34 and 44 enable vertical adjustment of the upper pad 30 so that it can conform with and accommodate vertical walls of various types of bathtubs or other receptacles or containers with which the appliance is used. Likewise, the telescopic connection enables the disassembly of the two sections of the frame thereby enabling the kneeling appliance to be stored in a compact manner and transported or handled in a compact manner. When in use, the lower pad is positioned closely adjacent the bathtub wall and the upper pad positioned in overlying relation to the top edge portion of the bathtub wall with the inclination of the upper pad enabling it to be effectively used even though a sliding door frame or the like may be positioned on top of the top edge portion 20 of the bathtub wall. This inclination also generally conforms with the inclination of the rib area or chest area of a person kneeling on the lower pad 28 and leaning toward the bathtub. The upper cushion is contacted by the rib area of the user which reduces discomfort caused by leaning against the rigid top wall portion 20 of the bathtub for long periods of time, such as is necessary when bathing an infant, cleaning the tub, or the like. While the frame as illustrated is generally Z-shaped, it could also be constructed with the side components of the frame being acutely angled in relation to each other, i.e., the top portion being acutely angled in relation to the bottom portion so that the horizontal inner connecting member between the lower legs would be positioned against the outer wall of the bathtub which would eliminate any possible discomfort which might occur if the knee area of a person was positioned over top of the outer portion of the cushion and the horizontal member 38. Also, as an alternative structure, structural components other than tubular members may be employed and the frame may be constructed of metal components, plastic components, or the like, which may be molded or otherwise formed into any desired construction having decorative appearances compatible with use in a bathroom. It is further pointed out that the device may be used in association with other containers having a vertical wall in which it is desired to lean over the vertical wall toward the interior of the container for some reason.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a bathtub including an outer side wall extending upwardly from a floor upon which said tub is supported, said outer side wall including an upper edge portion, a kneeling appliance for use by a person kneeling outwardly of and facing said outer side wall and desiring to reach down into said tub, said appliance including vertically spaced upper and lower frame portions and a connecting frame portion extending between and supporting said upper frame portion from said lower frame portion, said lower frame portion being substantially horizontal and supported from said floor immediately outwardly of said outer side wall and said upper frame portion being inclined, disposed closely over said upper edge portion, extending through a vertical plane containing the outer surface of said side wall and having its lower marginal portion disposed to the outer side of said outer side wall, said connecting frame portion extending between said lower frame portion and said lower marginal portion of said upper frame portion, said upper and lower frame portions each including an upwardly facing cushion supported therefrom.

2. The appliance of claim 1 wherein said cushions each comprise an envelope-type construction removably telescoped over the corresponding frame portion.

3. The appliance of claim 2 wherein said cushion supported from said lower frame portion is removably telescoped thereover from the side of said lower frame portion remote from said outer side wall and the cushion supported from said upper frame portion is removably telescoped thereover from the upper marginal edge thereof.

4. The appliance of claim 1 wherein said connecting frame portion includes structure for adjustably varying the effective height of said connecting frame portion.

5. The applicance of claim 4 wherein said connecting frame portion is substantially vertically disposed.

* * * * *